United States Patent [19]

Yano

[11] Patent Number: 4,803,877

[45] Date of Patent: Feb. 14, 1989

[54] PINCH APPARATUS USING ROLLS

[76] Inventor: Akechi Yano, 2, Kikusuidori 4-chome, Moriguchishi, Osakafu, Japan

[21] Appl. No.: 35,566

[22] Filed: Apr. 7, 1987

[30] Foreign Application Priority Data

Apr. 19, 1986 [JP] Japan ..... 61-91042

[51] Int. Cl.[4] ..... B21B 31/16; B21B 27/02

[52] U.S. Cl. ..... 72/248; 29/122; 29/116.1; 72/203; 72/243; 100/162 B; 100/168; 100/176

[58] Field of Search ..... 72/248, 243, 203, 204; 29/116 R, 116 A D, 122; 100/162 B, 168, 176

[56] References Cited

U.S. PATENT DOCUMENTS

| | | | |
|---|---|---|---|
| 1,317,713 | 10/1919 | Linder . | |
| 1,338,178 | 4/1980 | Henderson . | |
| 2,732,591 | 1/1956 | Whittum | 29/122 |
| 3,168,435 | 2/1965 | Beachler | 100/162 B |
| 3,728,767 | 4/1973 | Shirai | 29/116 A D X |
| 3,729,788 | 5/1973 | Tawa | 29/116 A D X |
| 3,884,623 | 5/1975 | Slack . | |
| 4,068,360 | 1/1978 | Freuler | 29/116 A D |
| 4,253,392 | 3/1981 | Brandon et al. . | |
| 4,305,191 | 12/1981 | Enomoto | 29/116 A D |

FOREIGN PATENT DOCUMENTS

| | | |
|---|---|---|
| 522752 | 11/1986 | Canada . |
| 86088167 | 11/1986 | European Pat. Off. . |

OTHER PUBLICATIONS

U.S. Defensive Publication T967,010, Feb. 7, 1978 by Stryjewski, "Fuser Roller".

*Primary Examiner*—Robert L. Spruill
*Assistant Examiner*—Steven B. Katz
*Attorney, Agent, or Firm*—Armstrong, Nikaido, Marmelstein & Kubovcik

[57] ABSTRACT

A pinch apparatus in which a pair of rolls, comprising rollers whose peripheral length decreases from the center portion in the axial direction towards each end disposed on the curved roller shaft rotatably, are arranged opposedly utilizing a flat part throughout the axial direction at an external periphery of the roller. The pinch apparatus feeds out a material being passed through in quantity corresponding to peripheral lengths in each part of the roller. The apparatus also includes an adjusting device which adjusts the shaft angle and roll ascending and descending portions.

5 Claims, 3 Drawing Sheets

PINCH APPARATUS USING ROLLS

BACKGROUND OF THE INVENTION

1. Field of the Invention

The present invention relates to a pinch apparatus comprising a pair of opposedly arranged rolls having rollers whose peripheral length decreases from the central part towards each end disposed rotatably on a curved roller shaft.

2. Description of the Prior Art

A known pinch apparatus comprises a pair of rolls, which consist of rollers whose peripheral length decreases from the central part towards each end. The pair of rolls are disposed rotatably on straight roller shafts arranged opposedly and contacting each other. The pinch apparatus is used, for example, when winding each of a plurality of parallel rows of tapes formed by separately slitting a rolled plate into long strips. When parallely feeding a plurality of rows of tapes, having slightly differed thickness, through the pinch apparatus, each tape has a constant length fed out regardless of the thickness of the tape. In this case, depending upon the difference in tape thickness, there is a difference in the wound diameter of each tape. Therefore, each tape must be wound separately with a plurality of winders rotating at speeds corresponding to each tape thickness.

SUMMARY OF THE INVENTION

It is an object of the present invention to provide a pinch apparatus comprising a pair of rolls having a peculiar shape arranged opposedly.

It is another object of the present invention to provide a pinch apparatus which, when a plurality of rows of tapes having slightly different thickness are fed in parallel, feeds out more at the central part of rolls.

It is a further object of the present invention to provide a pinch apparatus in which, when a plurality of rows of tapes having slightly different thicknesses are fed in parallel, the opposedly arranged state of rolls can be adjusted so as to obtain the contact pressure in conformity with each tape thickness.

Other features and advantages of the present invention will become clearer by the following description in connection with the accompanying drawings.

DETAILED DESCRIPTION OF THE EMBODIMENT

Figure 1:
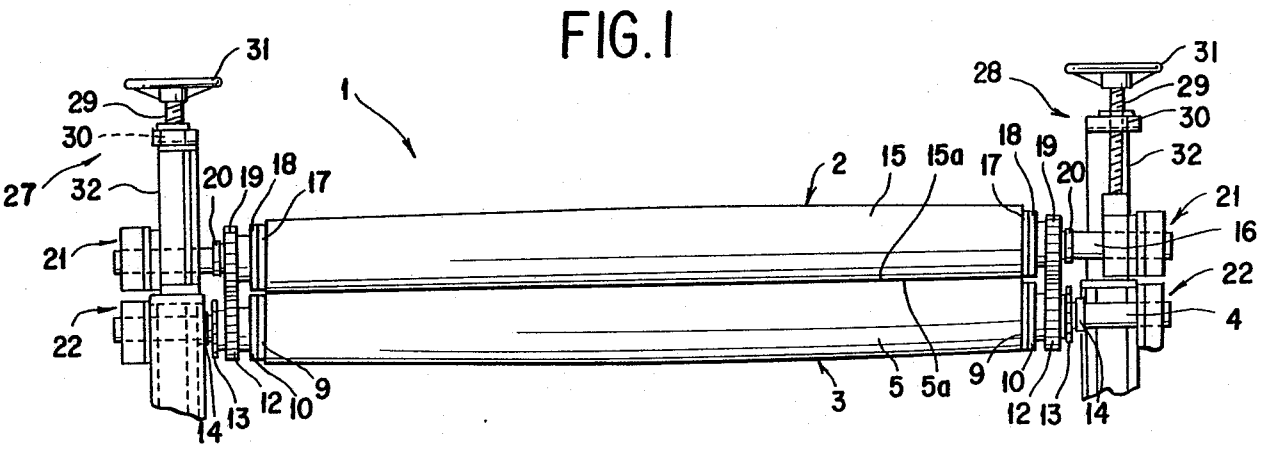
FIG. 1 is a front view of a pinch apparatus in accordance with the present invention.
Figure 2:
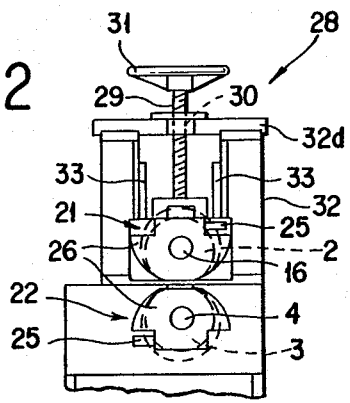
FIG. 2 is a right side view of the pinch apparatus.

Referring to the accompanying drawings, FIG. 1 and FIG. 2 show an embodiment of a pinch apparatus of the present invention comprising a pinch section 1 and arrangement adjusting means 21, 22, 27 and 28.

The pinch section 1 includes a pair of rolls 2 and 3 belonging to a linear type arranged opposedly to utilize linear parts 15*a* and 5*a*.

Figure 3:
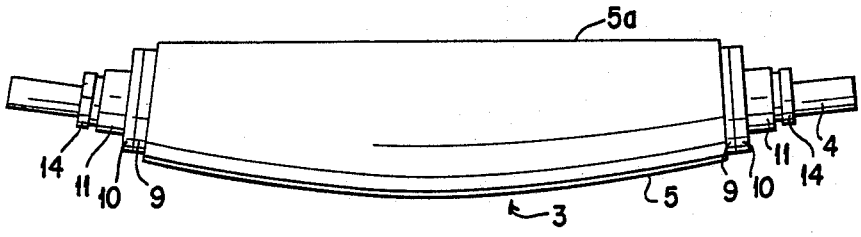
FIG. 3 is a front view of a lower roll of the pinch apparatus.
Figure 4:
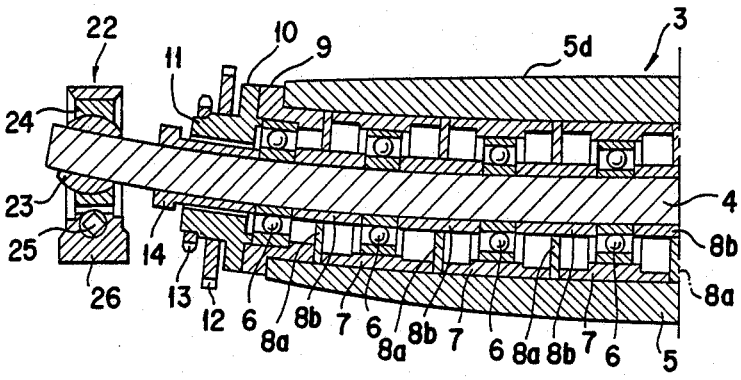
FIG. 4 is an expanded sectional view of left half of the roll mounted with a shaft angle adjusting portion.

As shown in FIG. 3, the roll 3 belongs to the linear type including a curved roller shaft 4 and a roller 5. As shown in FIG. 4, the roller 5 is disposed rotatably relative to the roller shaft 4 via a plurality of bearing 6 contained in bobbin case 7. Between each bobbin cases 7, ring spacers 8*a* having a constant thickness are disposed. An external shape of the roller 5 is in such a state that, the peripheral length reduces gradually towards each end from the central part in an axial direction. The upper roller periphery 5*a* forms a straight horizontal line axially when the roll 3 is arranged in such a state that the curved roller shaft 4 forms a catenary curve.

In FIG. 4, the numeral 8*b* denotes a sleeve provided on the roller shaft 4 for maintaining a distance between bearings 6. An end flange 9 is provided at the end of the roller 5. A collar flange 10 is mounted on the outside of the end flange. A gear 12 is fixed to a shell part 11 of the collar flange for synchronizing the rotation of the roller 5 and 15 and used for transferring a rotating force if circumstances require. A gear 13 is for receiving the rotating force of a driving source to assist rotation of the roller 5. A sleeve 14 is mounted on the roller shaft 4.

The roller 2 arranged symmetrically relative to the roll 3 has a same internal structure as the roll 3 aforementioned except for the gear 13. Thus, the numeral 15 is a roller, the numeral 15*a* is a linear part of the roller 15, the numeral 16 is a curved roller shaft, the numeral 17 is an end flange, the numeral 18 is a collar flange, the numeral 19 is a gear and the numeral 20 is a sleeve.

A surface layer of the rollers 5, 15 of the rolls 3, 2 is consisting of a rubber layer disposed on the bobbin cases 7. The rubber layer is formed continuously axially and when the roller 5, 15 rotate relative to respective roller shafts 4, 16, each part of the rubber layer expands and contracts axially corresponding to its rotating angle.

In FIGS. 1 and 2, the arrangement adjusting means comprises shaft angle adjusting portions 22, 21 provided respectively on opposite ends of the roller shafts 4, 16 and the roller ascending and descending portions 27 and 28 mounted on the opposite ends of the roller shaft 16 of the upper roll 2.

The shaft angle adjusting portions 21, 22 are for rotating the roller shafts 16, 4 respectively to adjust the arrangement angle of the rolls 2, 3. As it is apparent from FIG. 4, the shaft angle adjusting portion 22 comprises a spherical body 23 mounted with the roller shaft 4, an external frame 24 retaining the spherical body 23 rotatably, a screw shaft 25 engaged to a screw groove provided around the spherical body 23 to rotate the roller shaft 4 together with the spherical body 23 and a case 26 containing the external frame 24. Meanwhile, the internal structure of the shaft angle adjusting portion 21 is as same as that of the shaft angle adjusting portion 22.

The roll ascending and descending portions 27, 28 are for ascending and descending the upper roll 2 against the lower roll 3 fixed rotatably on the supporting member 32. The roll ascending and descending portion 28 is formed the same as the roll ascending and descending portion 27 is, as it will be apparent from FIG. 2. The portion 28 is coupled to the upper end of the case 26 of the shaft angle adjusting portion 21 so as to be only rotatable at its tip. The portion 28 comprises a screw shaft 29 engaged to a nut 30 incorporated in an upper end bar 32*a* of the supporting member 32. A handle 31 is secured to the upper end of the screw shaft 29. By operating the handle 31, the roll 2 is driven up and down along guide 33 disposed on the supporting member.

Thus, in the arrangement adjusting means in the embodiment, a gap, between the linear parts 15*a*, 5*a* as the opposing parts of the rollers 15, 5 of the rolls 2, 3, or the contact pressure in case of the contact arrangement, is adjusted by the roll ascending and descending portions 27, 28. While, a gap, between each part of the opposing parts 15*a*, 5*a* of the rollers in the axial direction, or the contact pressure in case of the contact arrangement, is adjusted by the shaft angle adjusting portions 21, 22.

Meanwhile, in the embodiment, though the arrangement adjusting means is formed by the shaft angle adjusting portions 21, 22 and the roll ascending and descending portions 27, 28 separately, the present invention is not limited thereto. That is, in the present invention, the shaft angle adjusting portion and the roll ascending and descending portion are not indispensable, either of two may be needed or they may be integrated. Furthermore, in the embodiment, they are designed for manual operation, but it is possible to construct as an automatic arrangement adjusting means interlocked with a feed back mechanism or the like. Thus, the arrangement adjusting means in accordance with the present invention may be constructed to adjust both or either of overall arrangement of a pair of opposedly arranged rolls and arrangement in each part of the pair of opposedly arranged rolls.

The roll used in the present invention is provided with the roller whose peripheral length decreases towards each end from the central part in the axial direction, rotatably on the curved roller shaft. By this configuration, a part of the roller periphery may be made flat axially. Also, external appearances of the peculiarly shaped roller at the quiescent and rotating time may be made same. In addition, the roller may keep the material being passed through on the roller surface. In addition, the pair of rolls can be advantageously arranged opposedly utilizing the partially flattened part on the roller periphery.

The roller in the roll deforms as rotating about the roller shaft. Thereby rotation of the roller against the curved roller shaft is made possible. The mode of deformation of the roller during the rotation may be classified into amplitude and elastic modes. In the amplitude mode, during the rotation against the curved roller shaft, amplitude of an axial curvature formed by the external shape of the roller is changed radially. The amplitude mode roller may be obtained, for example, by constructing the surface layer of the roller with a cylindrical body comprising a plurality of plates arranged in parallel. The members forming the surface layer of the roller are able to change the curvature as a whole, as sliding axially during its rotation against inner members consisting of the bobbin case 7 or the like aforementioned contacting thereto. In the elastic mode, during rotation against the curved roller shaft, the surface layer of the roller extends and contracts axially as rubber corresponding to its rotating angle. That is, when rotation moves from the inner diameter side to the outer diameter side of the roller shaft, the axial length of the roller extends, and it contracts when the rotation moves reversely. The elastic mode roller is advantageous in rotating smoothly against the roller shaft. Also, it is advantageous in that a pair of rolls may be arranged opposedly to contact each other in a state where a part of the roller is compressed flatly depending upon the expansibility and compressibility of the roller. Meanwhile, the roll having the elastic mode roller is particularly described in European Patent application No. 86308816.7, U.S. Ser. No. 127,624 which is a continuation of Ser. No. 927,864 or the Canadian patent application No. 522752.

From the point aforementioned, the surface layer of the roller is constructed with the material which allows deformation as changes of curvature or deflections in case of the amplitude mode, and with the flexible material having a rubber-like elasticity in case of the elastic mode. As the example of materials forming the roller surface layer, materials having a rubber-like elasticity represented by Ni-Ti alloy and Cu-Al alloy and ceramic may be given besides well known materials such as wood, rubber (rubber lining layer), plastic, usual metal and the like. The rubber roller is preferable from the viewpoint of a nonslip property of the material being passed through, and the metal or ceramic roller is preferable from the viewpoint of thermal stability. Particularly, the metal roller is also preferable from the viewpoint of dust rejecting property due to its conductivity. Meanwhile, the roller may have grooves or projections on its periphery for suitable purposes, for example, for the purpose of deflecting water or preventing slips. Also, rubber may be covered with well known materials such as cloth or sponge.

Figure 5:
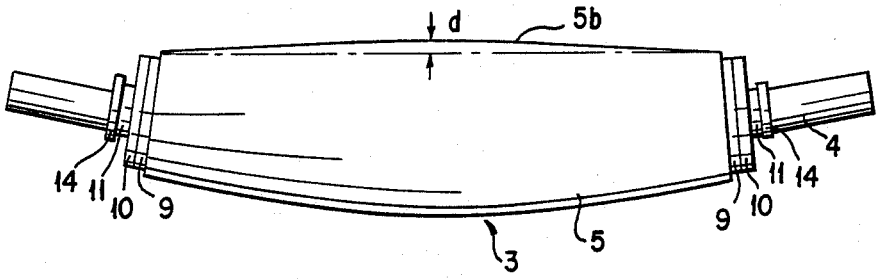
FIG. 5 is a front view of another roll used in a pinch apparatus in accordance with the present invention.
Figure 6:
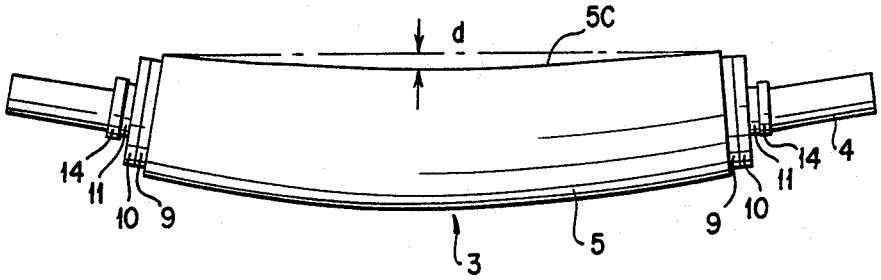
FIG. 6 is a front view of still another roll used in a pinch apparatus in accordance with the present invention.

As the shape of roller aforementioned, a linear type (FIG. 3) as in the embodiment described above, a convex type where the upper peripheral part 5*b* of the roller forms a convex curve as shown in FIG. 5, and a concave type where the upper peripheral part 5*c* of the roller forms a concave curve as shown in FIG. 6 may be given. The concave type roller includes a linear part between the upper peripheral part 5*c* and the lower part of the roller. Upper states (5*a*, 5*b*, 5*c*) on the roller periphery may be formed within a limit where the center line of the roller shaft in the silhouette forms a catenary curve when the curved roller shaft is projected on a vertical plane.

When disposing the roller rotatably against the curved roller shaft, if necessary, rotatonal insuring members or rotational subsidiary members, for example, such as automatic centering or usual ball-and-roller bearings, plain bearings or the like are used between the roller shaft and the roller. Also, if necessary, intermediate members comprising, for instance, a bobbin case, roller, below shaped cylinder or cylinder having a clockwise and counterclockwise spiral gaps defined at the center are used between the roller shaft and the forming material of the roller surface layer. The bellow shaped cylinder or the cylinder having the spiral gaps may be also used as the cover member of the bobbin case and roller or as the forming member of the roller surface layer. In particular, the roll formed with the cylinder having the spiral gaps is suitable for use where high revolution and large size are required, because the gap distance of the spiral is reduced corresponding to its rotational speed when the roller is rotated, thereby increasing the roller strength.

As the curvature of the roller shaft in the roll used in the present invention, the roller provided therewith may be within a rotatable limit against the roller shaft. The normal curvature of the roller shaft is 9 mm–400 m, depending upon its radius of curvature. Also, there is no particular limit as to the length and diameter of the roller shaft, the length is normally 8 mm–20 m and the diameter is 1 mm–5 m. The sectional shape or specification of the roller shaft is also not limited in particular. It may be of a round bar as in the embodiment described above, for example, a bar formed by combining a plurality of plates to show a radial cross section, or the configuration formed by containing the bar in a pipe. The latter imparts light weight and strength to the curved roller shaft or enables cooling of the roll via the roller shaft.

In the meantime, the dimensions of the roller is also not limited in particular. In general, the axial length is 4 mm–18 m, the maximum peripheral length at the central part is 10 mm–10 m and a difference between maximum peripheral length at the central part and the minimum peripheral length at end parts is 0.5 mm–1 m. Also, in the convex type roll (FIG. 5) and the concave type roll (FIG. 6), a gap between the roller surface at the center upper part of the roller (5*b*, 5*c*), when the roller shaft shows a maximum catenary cavity, and a straight line linking opposite ends of the roller is normally 0.1 mm–10 cm.

The roller shaft 4 in the roll 3 shown in FIG. 3 is composed of steel (55*c*) and its length is 1620 mm, the diameter is 45 mm and the radius of the curvature is 25717.7 mm. Also, the central diameter of the roller 5 is 154 mm, the end diameter is 120 mm, the length is 1200 mm and the thickness of the surface rubber layer is 8–15 mm. The bearing 6 is made of 6210ZZ(JIS). When forming the convex type rolls shown in FIG. 5 or FIG. 6 with the roller shaft and roller having same dimensons as hereinabove mentioned, the gap d between the roller surface at the upper-central part of the roller 5*b* or 5*c* and the straight line linking opposite ends of the roller is about 0.5 mm.

When forming the pinch section (1) by arranging a pair of rolls opposedly in the present invention, it is preferable to combine axial peripheral lines at the opposing part of each roller to engage each other. Thereby, the gap between rollers in the axial direction or the contact pressure in case of contacting engagemet may be balanced and the pinch force in the axial direction against the material being passed through can be constant. As for the example, there are combinations utilizing linear parts (15*a*, 5*a*) of two linear type rolls (2.3) (FIG. 1), utilizing linear parts of two concave type rolls (FIG. 6), utilizing linear parts of linear type and concave type rolls, and utilizing concave curve (5*c*) of the concave type roll and the curve (5*b*) of the convex type having the convex curve (5*b*) engaging to the concave curve. When forming the pinch section with a pair of rolls having the elastic type rollers, there is an advantage of arranging opposedly in a state where opposing parts of the rollers are compressed flatly, besides arranging opposedly in a state where the gap is formed or in a just contacting state. When it is arranged opposedly in the flatly compressed state, the larger pinch force can be effected.

In the pinch apparatus in accordance with the present invention, the material being passed through is hardly slipped in its feed out direction. Thus, a sufficient tension can be applied to prevent the passing material from loosening.

In the pinch apparatus in accordance with the present invention, when a plurality of rows of passing material having slightly different thickness are fed in parallel therethrough, the material being passed through is fed out in quantity corresponding to the peripheral length at each part of the roller. That is, the material being passed through is fed out more at the central part of the roller. Thus, it may be preferably used, for exmple, in a system where the rolled plate having different thicknesses at the central part and ends is slitted longitudinally, and a plurality of rows of tapes obtained in parallel are fed continuously to be wound as it is. In this case, each tape can be wound continuously in a state were uncoiling hardly takes place while applying a suitable tension to respective tape passing through the pinch apparatus. It is also possible to wind each tape in a good state using winders rotating at a same speed on the basis of a same rotating source.

The pinch apparatus in accordance with the present invention may be preferably used, for example, as an apparatus for merely feeding the material being passed through or as an apparatus for receiving it from the preceding process, as it has a superb function to feed out the material being passed through as suppressing meandering thereof.

In the pinch apparatus in accordance with the present invention, although the material being fed between a pair of rolls is not limited, it is generally a sheet material such as wide or narrow rolled plate, foil, cloth, paper, plastic film and the like.

What is claimed is:

1. A pinch apparatus comprising:

a pinch section consisting of a pair of rolls constituted by supporting rollers, whose peripheral length decreases from a central part in an axial direction towards each end, rotatably mounted on a curved roller shaft, said pair of rolls being arranged opposedly; and and adjusting means for adjusting an amount of roll in the pinch section, said adjusting means includes a shaft angle adjusting portion for rotating each said curved roller shaft, and a roll ascending and descending portion.

2. A pinch apparatus according to claim 1, wherein said pinch section has opposing roller peripheral parts forming a straight line throughout the axial direction.

3. A pinch apparatus according to claim 1, wherein the supporting rollers of the pair of rolls are elastic rollers.

4. A pinch apparatus according to claim 1, wherein each of said pair of rolls in said pinch section are in contact with each other.

5. A pinch apparatus according to claim 1, wherein said pair of rolls in said pinch section has a gap formed therebetween for passing a thickness of a material therethrough.

* * * * *